US007473095B2

(12) United States Patent
Gaur et al.

(10) Patent No.: US 7,473,095 B2
(45) Date of Patent: Jan. 6, 2009

(54) $NO_X$ EMISSIONS REDUCTION PROCESS AND APPARATUS

(76) Inventors: Siddhartha Gaur, 7521 England Dr., Plano, TX (US) 75025; Vibha Bansal, 7521 England, Plano, TX (US) 75025

( * ) Notice: Subject to any disclaimer, the term of this patent is extended or adjusted under 35 U.S.C. 154(b) by 366 days.

(21) Appl. No.: 11/118,131

(22) Filed: Apr. 29, 2005

(65) Prior Publication Data

US 2006/0246385 A1 Nov. 2, 2006

(51) Int. Cl.
*F23G 7/08* (2006.01)
*F23J 15/00* (2006.01)
*F23D 14/00* (2006.01)

(52) U.S. Cl. ..... 431/5; 431/160; 110/210; 110/345

(58) Field of Classification Search ..... 431/5, 431/2, 160; 110/210, 345
See application file for complete search history.

(56) References Cited

U.S. PATENT DOCUMENTS

| | | | |
|---|---|---|---|
| 5,400,746 | A | 3/1995 | Susa et al. |
| 5,593,480 | A | 1/1997 | Poschl |
| 5,636,619 | A | 6/1997 | Poola et al. |
| 5,649,517 | A | 7/1997 | Poola et al. |
| 5,783,160 | A | 7/1998 | Kinugasa et al. |
| 5,960,777 | A | 10/1999 | Nemser et al. |
| 6,067,973 | A | 5/2000 | Chanda et al. |
| 6,170,264 | B1 | 1/2001 | Viteri et al. |
| 6,289,884 | B1 | 9/2001 | Blandino et al. |
| 6,453,893 | B1 | 9/2002 | Coleman et al. |
| 6,543,428 | B1 | 4/2003 | Blandino et al. |
| 6,598,398 | B2 | 7/2003 | Viteri et al. |
| 6,722,352 | B2 | 4/2004 | Smolarek et al. |
| 6,742,507 | B2 | 6/2004 | Keefer et al. |
| 6,875,009 | B2 | 4/2005 | Kayahara et al. |
| 2003/0015185 | A1 | 1/2003 | Dutart |

(Continued)

FOREIGN PATENT DOCUMENTS

| | | |
|---|---|---|
| WO | WO-94/15698 | 7/1994 |

(Continued)

OTHER PUBLICATIONS

James A. Miller et al.; Chemical Kinetics and Combustion Modeling; Annu. Rev. Phys. Chem. 1990, 41:345-387.

*Primary Examiner*—Alfred Basichas
(74) *Attorney, Agent, or Firm*—Osha Liang LLP; John W. Montgomery

(57) ABSTRACT

A method and apparatus for afterburning of hydrocarbon with air. Exhaust gas from a process in which hydrocarbon has been evolved is combusted with air to produce reduced $NO_X$ emissions. Hydrocarbon fuel is burned in an air mixture at an equivalence ratio of less than 1 oxygen to 1 hydrocarbon fuel (ER<1:1) above a temperature of about 900° C. in a burning zone for a sufficient time to combine substantially all of the oxygen in the fuel/air mixture with disassociated carbon and hydrogen components of the hydrocarbon fuel and to produce carbon dioxide, water, and a portion of unburned light hydrocarbons. The unburned light hydrocarbon gas is cooled in a cooling zone to below a relatively lower temperature of about 800° C. The unburned light hydrocarbon gas is oxidized substantially completely at less than a temperature of about 800° C. so that a reduced amount of thermal $NO_X$ results from the combustion and oxidation.

13 Claims, 2 Drawing Sheets

U.S. PATENT DOCUMENTS

| | | | | |
|---|---|---|---|---|
| 2004/0003592 | A1 | 1/2004 | Viteri et al. | |
| 2004/0261670 | A1 * | 12/2004 | Dueck et al. | 110/231 |
| 2005/0081800 | A1 | 4/2005 | Davidson | |

FOREIGN PATENT DOCUMENTS

| | | | |
|---|---|---|---|
| WO | WO-99/42709 | | 8/1999 |
| WO | WO-99/67508 | | 12/1999 |
| WO | WO-00/15951 | A1 | 3/2000 |
| WO | WO-02/42628 | | 5/2002 |

* cited by examiner

$NO_X$ EMISSIONS REDUCTION PROCESS AND APPARATUS

BACKGROUND OF INVENTION

1. Field of the Invention

The invention relates generally to emission control processes and devices for treating exhaust gasses produced by industrial hydrocarbon fuel burning processes involving the burning or other industrial processes evolving hydrocarbon and more particularly to processes for afterburning of exhaust gasses, afterburning systems, and afterburning devices for the reduction of $NO_X$ emissions.

2. Background Art

Industrial combustion exhaust gas emissions, and particularly emissions from automotive fuel burning and industrial fuel burning, include quantities of various undesirable chemical components including nitrogen oxides such as NO, $NO_2$, $NO_3$, and . . . $NO_X$. Nitrogen oxides, commonly referred to as $NO_X$ or NOX, are a group of highly reactive gases, all of which contain nitrogen and oxygen in varying amounts. Many of the nitrogen oxides are colorless and odorless. However, one common pollutant, nitrogen dioxide ($NO_2$) along with particles in the air can often be seen as a reddish-brown layer over many urban areas.

Nitrogen oxides form when fuel is burned at high temperatures, as in a hydrocarbon fuel and air combustion process. The primary manmade sources of $NO_X$ are motor vehicles, electric utilities, and other industrial, commercial, and residential sources that burn fuels. $NO_X$ can also be formed naturally. In the US the Environmental Protection Agency (EPA) tracks emissions of $NO_X$ along with five other principal air pollutants carbon monoxide, lead, particulate matter, sulfur dioxide, and volatile organic compounds. In other industrialized countries $NO_X$ is also tracked, for example, emissions reporting under the Integrated Pollution Prevention and Control (IPPC) Directive and the European Pollutant Emission Register (EPER).

$NO_X$ causes a wide variety of health and environmental impacts because of various compounds and derivatives in the family of nitrogen oxides, including nitrogen dioxide, nitric acid, nitrous oxide, nitrates, and nitric oxide. Examples of such adverse conditions include ground level ozone or smog that is formed when $NO_X$ and volatile organic compounds (VOCs) react in the presence of sunlight. $NO_X$ and sulfur dioxide react with other substances in the air to form acids which fall to earth as rain, fog, snow or dry particles (all known gas acid rain). $NO_X$ reacts with ammonia, moisture, and other compounds to form nitric acid and related particles. Human health concerns include effects on breathing and the respiratory system, and damage to lung tissue when small particles penetrate deeply into sensitive parts of the lungs and cause or worsen respiratory disease such as emphysema and bronchitis, and aggravate existing heart disease. Nitrate particles and nitrogen dioxide can also block the transmission of light and thereby reduce visibility. Increased nitrogen loading in water bodies, particularly coastal estuaries, causing water quality deterioration by upsetting the chemical balance of nutrients used by aquatic plants and animals. $NO_X$ is also considered to contribute to global warming because one member of the $NO_X$, nitrous oxide, is a greenhouse gas that is thought to accumulate in the atmosphere with other greenhouse gasses to cause a gradual rise in the earth's temperature. In the air, $NO_X$ reacts readily with common organic chemicals and even ozone, to form a wide variety of potentially toxic chemicals such as the nitrate radical, nitroarenes, and nitrosamines.

One of the ways governmental agencies, such as the EPA in the U.S. have attempted to reduce emissions deemed to be toxic, harmful, or undesirable, is by mandating and monitoring the quality of exhaust emissions. In many instances the governmental regulations indicate that the best known process for reducing the pollutants should be used and that the amount of emissions tolerated for any given producer will not exceed a specified amount. Industry has worked to establish processes designed to reduce or eliminate such substances from the exhaust streams of industrial fuel burning processes. The mechanism for accomplishing reduced emissions can be by reducing the production of unwanted substances during burning, by providing an afterburning process for the exhaust from the primary burning process, and/or by chemically extracting or scrubbing the substances found in the exhaust stream. In the case of producing heat with a controlled fuel such as the burning of methane, low $NO_X$ burners have been developed. These devices use controlled content clean burning natural gas (methane $H_3C$). In some low $NO_X$ burners there are two stages of burning. For example, one stage has a carefully controlled mixture of methane and air to produce a fuel rich high temperature flame and a second stage with additional air injected into the flame in sufficient amounts to both reduce the temperature and to provide complete combustion of any remaining methane fuel. These controlled methane fuel burners can be adequately controlled to significantly reduce production of either chemical $NO_X$ or thermal $NO_X$ In other processes where methane is not the only hydrocarbon compound that is evolved or burned, the initial heat might be provided by a low $NO_X$ burner, however once the other uncontrolled hydrocarbon fuel begins combustion the production of $NO_X$ was no longer controlled.

The traditional wisdom for the reduction of pollution, prior to the present invention, was to provide an after burner or a scrubber in the exhaust stream. In the case of an after burner, it was operated at a very high temperature typically above about 870° C.-950° C. For example, the EPA requirements for after burning of emissions from a sweat furnace require a residence time of 0.8 seconds and a temperature above 870° C. and EPA requirements for sludge incineration requires temperatures of about 925° C. (See example article found at www.epa.gov/ttn/atw/alum2nd/secalum.pdf.) The EPA requirements also provide for excess amounts of air, for example, in the case of sludge incinerations as much as 50%-100% excess air. The intent is to provide a combustion oxidation reaction with an amount of air to exceed the stoichiometric ratio for complete and rapid combustion so that all the hydrocarbon compounds remaining in the exhaust after the initial burning are completely burned in the after burner.

Thus, in the case of burning of hydrocarbon fuels, one primary consideration has been to attempt to burn all of the hydrocarbons as completely as possible. In most industrial burning processes, combustion is not always as complete as desired. The burning temperature and the time of burning are often dictated by the process and the fuel available for the process whether for heat generation for a particular industrial process, for steam production and electrical energy generation, for manufacturing such as concrete production in industrial steel furnaces or for other industrial processes. In many processes such as steam generation and concrete clinker production, low $NO_X$ burners are used at the initial stages to raise the temperature of other hydrocarbon fuel such as coal, heating oil, or other hydrocarbon fuel up to ignition temperature and to ignite and maintain the burning of the primary source of hydrocarbon fuel. Even where low $NO_X$ burners are used in the initial ignition and combustion maintaining part of a process, without producing excessive $NO_X$, It has been found that while the low $NO_X$ methane burners have a burner flame that is controlled to produce little $NO_X$, the remainder of the heated and them ignited hydrocarbon generally produces significant amounts of $NO_X$. The hydrocarbon burning processes produce unwanted substances in the exhaust stream. Those substances must be adequately reduced in quantity in an after burning process and/or scrubbed from the exhaust stream using a high temperature catalytic scrubbing process.

The currently established standards, for industrial afterburners used on hydrocarbon burning exhaust, generally indicate burning remaining hydrocarbon fuels at temperature over about 950° C.-1000° C. in an oxygen rich atmosphere. Many facilities that attempt to comply with such standards for industrial combustion and after burner combustion processes seek to provide combustion at temperatures that exceed 1000° C. At such high burning temperatures all of the largest hydrocarbon chains typically found in commercial hydrocarbon fuels break down into lighter, volatile hydrocarbon chains that facilitate complete combustion. Complete combustion is insured by burning the exhaust gasses with excess oxidant for a sufficient period of time before finally discharging the exhaust gasses. Thus, the established best available processes for burning hydrocarbon with $O_2$, require an excess amount of quantity of $O_2$ and a sufficient time to provide complete combustion of all of the hydrocarbon components from the fuel. Generally, oxygen:fuel ratios of greater than 1.0:1.0 for example 1.1:1.0 are considered desirable to insure complete combustion/oxidation of all carbon ($C_x$) and hydrogen ($H_y$) in the fuel. Typically, and most economically, industrial combustion occurs in an atmosphere of air and is provided together with the air at a ration of $21(O_2):79(N_2)$. For purposes of discussion, the ratio of $O_2:N_2$ will be approximated herein as a ratio of about 2:8 and it will be understood by those skilled in the art that the actual ratio in air is closer to 2.1:7.9. Complete combustion of hydrocarbon fuel generally means that $CH_4$ will combine with $2O_2$ to form $CO_2$ and $2H_2O$.

$$CH_4+2O_2 \rightarrow CO_2+2H_2O \quad (1)$$

In order to have an adequate supply of $O_2$ for complete combustion with one mole of $CH_4$, the quantity of the air will need to have 2 moles $O_2$. Generally speaking, and according to the approximation discussed above, there are 2 moles of $O_2$ and 8 moles of $N_2$ in any standard quantity of 10 moles of air ($2O_2+8N_2=10$Air). Thus, when burning in air, an equivalency ratio (ER) of greater than 1 (ER>1.0) requires more than about 10 moles of air for 1 mole of CH4 (for example 10.1Air: $1.0C_x$). A generalized chemical equation (assuming air has an approximate ratio of $2O_2:8N_2$) for combustion of $CH_4$ may be expressed as follows in equation (2) below:

$$1 \text{ Mole } CH_4+10 \text{ Moles AIR } (2O_2 \text{ and } 8N_2) \rightarrow CO_2+2H_2O+8N_2 \quad (2)$$

When there is complete combustion of hydrocarbon with excess air at high temperatures two kinds of $NO_X$ are formed. Chemical $NO_X$ results from $O_2$ combining with N from the hydrocarbon to form chemical $NO_X$. It has been found by the inventors that the amount of chemical $NO_X$ is not normally significant and in most cases, if all the nitrogen from the fuel combines to form chemical $NO_X$, that amount of $NO_X$ (i.e., the maximum possible amount of chemical $NO_X$) would not by itself exceed the minimum permissible standards for air quality pursuant to U.S. EPA regulations and most governmental requirements throughout the world. However, when there is excess air ($O_2$ and $N_2$) at high burning temperatures for a sufficient time, significant and troublesome quantities of thermal $NO_X$ forms. Thermal $NO_X$ results from $O_2 \rightarrow 2O$ and $N_2 \rightarrow 2N$ at the high temperature and then N and (X) times O combining to form thermal $NO_X$. The formation of thermal $NO_X$ increases exponentially (a second order parabolic function) with increase in temperature. Chemical $NO_X$ is not a major problem and the amount of chemical $NO_X$ can be controlled further by appropriately controlling the composition of the fuel, for example by using hydrocarbons having reduced nitrogen components. In burning processes where air is the oxidant, thermal $NO_X$ formation is a big concern. The high temperature burning process that controls unburned hydrocarbon emissions simultaneously promotes the formation of thermal $NO_X$ and a scrubbing unit is typically required in the exhaust gas stream to remove $NO_X$ to an acceptable level. Thus, prior to the present invention, scrubbing of exhaust gasses to remove the $NO_X$ has been a costly necessity for most fuel burning industries.

SUMMARY OF INVENTION

In one embodiment a method for afterburning of hydrocarbon with air is provided. Exhaust gas, from a process in which hydrocarbon has been evolved, is combusted with air to produce reduced $NO_X$ emissions. Hydrocarbon fuel is burned in an air mixture at an equivalence ratio of less than 1 oxygen to 1 hydrocarbon fuel (ER<1:1) above a temperature of about 90° C. in a burning zone for a sufficient time to combine substantially all of the oxygen in the fuel/air mixture with disassociated carbon and hydrogen components of the hydrocarbon fuel and to produce carbon dioxide, water, and a portion of unburned light hydrocarbons. The unburned light hydrocarbon gas is cooled in a cooling zone to below a relatively lower temperature of about 800° C. The unburned light hydrocarbon gas is oxidized substantially completely at less than a temperature of about 800° C. so that a reduced amount of thermal $NO_X$ results from the combustion and oxidation. In another embodiment an afterburner for afterburning of hydrocarbon with air is provided. Other aspects and advantages of the invention will be apparent from the following description and the appended claims.

DETAILED DESCRIPTION

Figure 1:
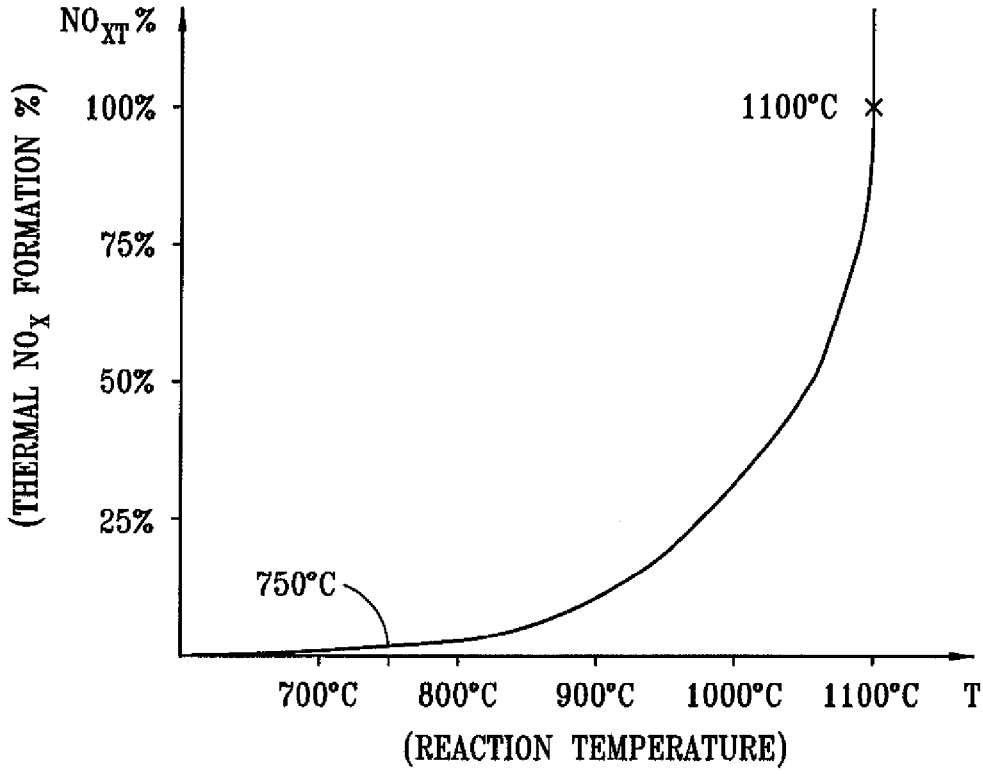
FIG. 1 is a graph for combustion of hydrocarbon in air showing percentage of thermal $NO_X$ formation ($NO_X$) versus reaction temperature (T).

One embodiment of the invention includes an afterburning method and apparatus for combustion in air of hydrocarbons that remain in an exhaust stream after an industrial process involving the evolution of hydrocarbon fuels. Many types of industrial processes that may include coal burning, oil burning, gas burning, wood burning, bio mass and waste incineration, and other processes such as steam generation, concrete clinker formation, coke formation, carbon alloy production, steel and other metal production, firing of ceramic, refractory processes, and other industrial processes typically evolve hydrocarbon fuels (sometimes undetermined and uncontrolled types of hydrocarbon fuels) or otherwise cause the evolution of hydrocarbons of different types. Generally, in such processes much of the hydrocarbon provided as fuel for the process breaks down or evolves into other smaller or different hydrocarbons and into component parts that are combusted or otherwise oxidized. The invention in its various embodiments provides afterburning methods and apparatuses for reducing or eliminating both the remaining hydrocarbon evolved from the industrial process and also the $NO_X$ in the exhaust. Hydrocarbon in an exhaust stream from an industrial process is burned by an afterburner and in an air mixture at an equivalency ratio (ER) of less than 1. This means that there is less than 1 mole of oxidant (for example $O_2$ from the air) available to combine with each mole of hydrocarbon components (namely, xC and yH from any hydrocarbon $C_xH_y$ that was evolved in the industrial process). The lean oxidant and rich hydrocarbon mixture is burned at a sufficiently high temperature typically above about 900° C. at normal pressure ranges, in a burning zone for a sufficient time to combine substantially all of the disassociated carbon and hydrogen components of the hydrocarbon fuel with the oxygen in the mixture produced in the afterburner process and apparatus. This initial afterburner combustion produces carbon dioxide, water, and a portion of yet unburned light hydrocarbons $C_vH_w$. The unburned hydrocarbon resulting from this high temperature burning is typically in the form of light volatile gas. The unburned hydrocarbon gas is cooled (the temperature is towered relative to the high temperature of the initial afterburning) in a cooling zone to less than the temperature required for breaking the bonds of the $N_2$ found in the air, at standard sea level conditions this temperature is typically less than about 800° C., for example about 750° C. Additional oxidant in excess amounts, such as the $O_2$ in air to provide an equivalency ratio ER greater than one (oxidant: hydrocarbon=ER>1), is combined with the lower temperature unburned light hydrocarbon gas so that any unburned hydrocarbon is oxidized substantially completely at the lower temperature. It is noted that the strong bonds of large hydrocarbon chains had already been broken in the burning zone of the afterburning process. The lower temperature is selected so that the $N_2$ bonds do not break or at least are less likely to break at the lower temperatures. The lower temperature range is selected so that it is sufficiently high so that the light hydrocarbons oxidize without difficulty, for example above about 650° C. A lower temperature less than about 800° C. and greater than about 650° C. has been found to be a useful range. For example about 750° C. has been found to be useful. At the lower temperature the strong $N_2$ bonds do not readily break and therefore little, if any, thermal $NO_X$ results from the completion of the oxidation of all the remaining hydrocarbons.

According to one embodiment of the invention includes an afterburner apparatus for combustion of remaining hydrocarbon fuel in air to eliminate the hydrocarbon and produce exhaust having reduced $NO_X$ emissions. The apparatus has a high temperature burning zone for burning hydrocarbon fuel in air. The mixture in the high temperature burning zone is controlled at an equivalence ratio of less than 1 oxygen to 1 hydrocarbon fuel (ER<1.0) at a temperature of above about 900° C. for a sufficient time to combine substantially all of the oxygen in the fuel/air mixture with disassociated carbon and hydrogen components of the hydrocarbon fuel. A major portion of the fuel combines with oxygen in the burning zone. A temperature lowering zone is in fluid communication with the burning zone to the receive gas from the burning zone. A cooling device lowers the hot gas in the cooling zone to a temperature of less than the temperature at which $N_2$ bonds would break in the atmosphere of the temperature lowering zone. An oxidizing zone follows the temperature lowering zone to receive the lower temperature gas. A source of an oxidant, such as air to provide oxygen, is connected to the oxidizing zone to provide at least a sufficient amount of oxidant, and preferably and excess amount of oxidant (for example ER>1:1), to oxidize any unburned gas substantially completely at a lowered temperature of less than about 800° C. so that little if any thermal $NO_X$ results in the oxidation zone. At the lower temperature $N_x$ will not normally disassociate into 2N such that the nitrogen in the air is not available to combine and to thereby form $NO_X$.

To understand the invention and its advantages and benefits it is helpful to understand the processes by which $NO_X$ emissions are reduced by burning fuels in high temperature oxygen rich fuel burning processes. A time honored concept is that by burning a fuel that is appropriately stabilized so that it does not produce excess sulfur and excess nitrogen to eliminate all uncombined sulfur and nitrogen components from the fuel. The present invention is focused upon preventing or reducing thermal $NO_X$ formation in an afterburner process in an afterburner apparatus and $SO_X$ will not be addressed at great length, other than to observe that it plays a role in normal fuel combustion. At sufficiently high temperatures all the hydrocarbon ($C_xH_y$) chain bonds in the fuel should be broken for combustion or chemical oxidation and recombination of the components during combustion within a reasonable time obtainable in a continuous burning process. For some commercially available fuels, temperatures above about 900° C. may be sufficient and for almost any commercially available hydrocarbon fuels temperatures above about 950° C. will be sufficient to break all the hydrocarbon bonds sufficiently to permit oxidation of the carbon and other components. With more than enough $O_2$ for stoichiometric chemical reaction of the components, there should be complete combustion. Those skilled in the art will recognize from this disclosure that generally higher temperatures require shorter time periods and higher amounts of oxidant will require shorter periods of time for complete combustion.

A typical generalized chemical equation for the burning of fossil fuels (hydro carbons such as petroleum and coal) in air is as shown in equation (3) below:

$$C_xH_yN_{z1}O_{z2}S_{z3}+ER_{HT}(O_2N_2)\rightarrow a(CO_2)+b(H_2O)+c(C_vH_2)+[d(SO_{x2})+e(NO_x)+f(O_2)+g(N_2)] \quad (3)$$

where, $$ER_{HT}>1.0 \quad (4)$$

($ER_{HT}$ is the equivalency ratio of oxidant:fuel for the high temperature burning);

where, $$v,w,z1,z2,z3<<x,y; \quad (5)$$

where, a, b, c, d, e, f, and g are coefficients determined by the values of v, w, x, y, and z such that the chemical equation is balanced;

and where, $$NO_X=e1(\text{chemical } NO_X)+e2(\text{thermal } NO_X). \quad (6)$$

It will be recognized that $CO_2$, $H_2O$, $O_2$, and $N_2$ are all "good" environmentally safe resultant components. Any amount of remaining hydrocarbon $C_vH_w$ that is exhausted as emissions is deemed undesirable or "bad." However, in a typical oxygen rich and fuel lean burning environment, namely because ER>1.0 and because the combustion temperature is high, it is expected that there will be little if any unburned hydrocarbon and thus the coefficient "c" in equation (3) will be equal to 0, or at most will be very small. The $SO_X$ and $NO_X$ (regardless of the source, whether chemical $NO_X$ or thermal $NO_X$) are all potentially "bad" components. After combustion in prior industrial fuel burning processes or other processes in which hydrocarbons are evolved, after burners, $SO_X$ scrubbers, and $NO_X$ scrubbers would be required in the final exhaust stream in order to reduce emissions of the potentially environmentally harmful "bad" resultant components of combustion. Scrubbers are both expensive and expensive to operate. The present invention is designed to help eliminate or reduce the need for an $NO_X$ scrubber.

The present invention addresses the reduction or elimination of both unburned hydrocarbons and a significant portion of $NO_X$ in an exhaust afterburner. A particular emphasis is placed on eliminating the hydrocarbon while avoiding production of thermal $NO_X$. For clarity of understanding herein chemical $NO_X$ and thermal $NO_X$ will be specified when it is important to make the distinction in the context of use, and $NO_X$ will be referred to without designating whether it is chemical $NO_X$ or thermal $NO_X$ when the distinction is not required for proper understanding. Chemical $NO_X$ is that component of $NO_X$ that is formed from the chemical components of nitrogen found chemically bonded in the hydrocarbon fuel. In most cases as discussed herein, the amount of chemical $NO_X$ is not normal significant and the focus of the invention is on the reduction of thermal $NO_X$.

In prior afterburning processes, substantially all carbon C and hydrogen molecules H were intended to be disassociated from long hydrocarbon chains $C_xH_y$ by providing high temperature burning. The evolved or disassociated components were to be completely re-combined as $CO_2$ and $H_2O$ during combustion by providing excess air. It will be understood that excess air may be quantified by an equivalence ratio of oxygen to hydrocarbon greater than 1.0:1.0. This indicates that a stoichiometric molar balance for combined carbon and oxygen and for combined hydrogen and oxygen results excess oxygen. A target ratio of about 1.1:1.0 (i.e., ER=1.1) has been typical for many prior afterburners to provide "clean" burning so that all hydrocarbon is combined with oxygen. For truly clean burning this would mean that substantially all C forms into $CO_2$ and all H forms into $H_2O$.

As pointed out in this disclosure, the inventors have found that the thermal $NO_{XT}$ can be reduced or eliminated by reducing or eliminating any excessive oxidant (basically $O_2$ from air) in the high temperature burning reaction. It will be understood from this disclosure that in prior processes it is the high burning temperature that insures complete hydrocarbon chain disassociation, however not only do you obtain breaking of hydrocarbon bonds of the fuel components, there is thermal cracking of the $N_2$ in the air to free the nitrogen and thereby form 2N. The previous wisdom of providing excess $O_2$, was effective to provide complete combustion of all the hydrocarbon components. However, the excess $O_2$ that is left over from the complete burning process also cracks and forms 2O and the freed O then variously combines with the freed N and forms thermal $NO_X$. Reducing the amount of $O_2$ below the stoichiometric molar balance amount (i.e., below ER=1) is contrary to popular wisdom because lean oxygen and rich fuel burning does not combust all of the hydrocarbon components. The inventors have found that only reducing the amount of oxygen is not itself an acceptable solution because, without excess $O_2$ for the combustion process, the resultant exhaust stream would contain unburned, light hydrocarbon fractions $C_vH_w$ (where v, w<<x, y). Thus, according to an embodiment of the present invention a second stage of oxidation in an oxygen rich and fuel lean environment is provided to oxidize the unburned hydrocarbons at below a lower temperature. The lower temperature is selected below a range at which $N_2$ readily cracks such that the additional oxidation of remaining light hydrocarbon can be accomplished without forming thermal $NO_{XT}$.

According to one embodiment of the invention, $NO_X$ emissions are reduced by burning exhaust gases in an after burner at a temperature above about 950° C. in an oxygen lean environment. For example, the equivalence ratio ER for oxidant:fuel is slightly less than 1 (ER<1.0), for example in a range of about 0.9<ER<1.0. An example of the chemical reaction for combustion of hydrocarbon fuel in such an oxygen lean atmosphere might be determined by returning to equation (3) with the modification of provident an ER<1.0 as expressed as in equation (7) below:

$$C_xH_yN_{z1}O_{z2}S_{z3}+ER_{HT}(O_2N_2)\rightarrow a(CO_2)+b(H_2O)+c(C_vH_w)+[d(SO_{x2})+e(NO_x)+f(O_2)+g(N_2)] \quad (3)$$

where, $$ER_{HT}<1.0 \quad (7)$$

($ER_{HT}$ is the equivalency ratio of $O_2$ to fuel for the high temperature burning);

where, $$v,w,z1,z2, \text{ and } z3<<x,y; \text{ and} \quad (5)$$

where, a, b, c, d, e, f, and g are coefficients determined by the values of v, w, x, y, and z such that the chemical equation is balanced.

Because there is insufficient $O_2$ for complete combustion and because C and H combine with oxygen more rapidly than N combines with oxygen, it is unlikely (although not impossible) that any N evolved from the hydrocarbon fuel will form chemical $NO_X$ in the oxygen lean and fuel rich atmosphere. Because there is not enough oxidant to combine all the hydrocarbon and because the reactions leading to the formation of $CO_2$ and $H_2O$ generally occur more rapidly or are preferred, the amounts of thermal $NO_X$, chemical $NO_X$, and $O_2$ will be 0 or very small. The equation might be represented by an equation (8) as follows:

$$C_xH_yS_{z1}N_{z2}O_{z3}+(0.99)O_2\rightarrow CO_2+H_2O+(0.01)C_vH_w, \quad (8)$$

where, (0.99) is representative of an equivalents ratio of $O_2$, where, (0.01) is representative of the residual amount of hydrocarbon unburned because of the rich fuel and lean oxygen mixture, and where, v, w, z1, z2, and z3<<x, y.

A concern has previously been that this results in undesirable light hydrocarbons $C_vH_w$. Even a small fraction of the light hydrocarbon, for example one hundredth of a percent (0.01 $C_vH_w$), multiplied by large volumes of burning exhaust gases can result in a significant amount of pollution. These light or small chain hydrocarbons are extremely volatile and therefore might be deemed unsafe for discharging in the exhaust gases.

According to an embodiment of the present invention, the light hydrocarbons can be eliminated in a second stage of a process without creating $NO_X$. The exhaust gas stream is cooled or lowered to a temperature below the thermal cracking temperature for the $N_2$ in the air, for example about 750° C., or in a range of less than about 800° C. and more than about 600° C. It will be understood with reference to the representative graph of thermal $NO_X$ formation versus temperature, as shown in FIG. 1, that the amount of thermal $NO_X$ formed increases exponentially above about 750° C. such that big advantages can be obtained for the reduction of $NO_X$ formation where oxidation of the hydrocarbon in air is conducted a temperatures below about 800° C. With the entire gas stream at the lower temperature, additional air is added to provide a source of excess oxygen for oxidation with the remaining unburned hydrocarbons $C_vH_w$. Because high temperatures are not required to break the carbon/hydrogen bonds of the longer chain hydrocarbons, $C_xH_y$ (i.e., because of the volatility of the short chain, light hydrocarbons, $C_vH_w$), complete oxidation or combustion will take place at temperatures below about 800° C., or below about 750° C., provided there is a sufficient supply of excess $O_2$. Some of the gains obtained in reducing $NO_X$ formation further at lower temperatures below about 700° C. may be offset by the slower speed of the oxidation reaction and potentially incomplete oxidation at such lower temperatures. The oxidation reaction might be expressed in equation (9) as follows:

$$CO_2+H_2O+C_vH_{w\ (volatile\ unburned\ hydrocarbon)}+(1.001\text{-}1.200)O_2 \rightarrow CO_2+H_2O, \quad (9)$$

where, (1.001-1.200) represents a range equivalence amounts of $O_2$.

Figure 2:
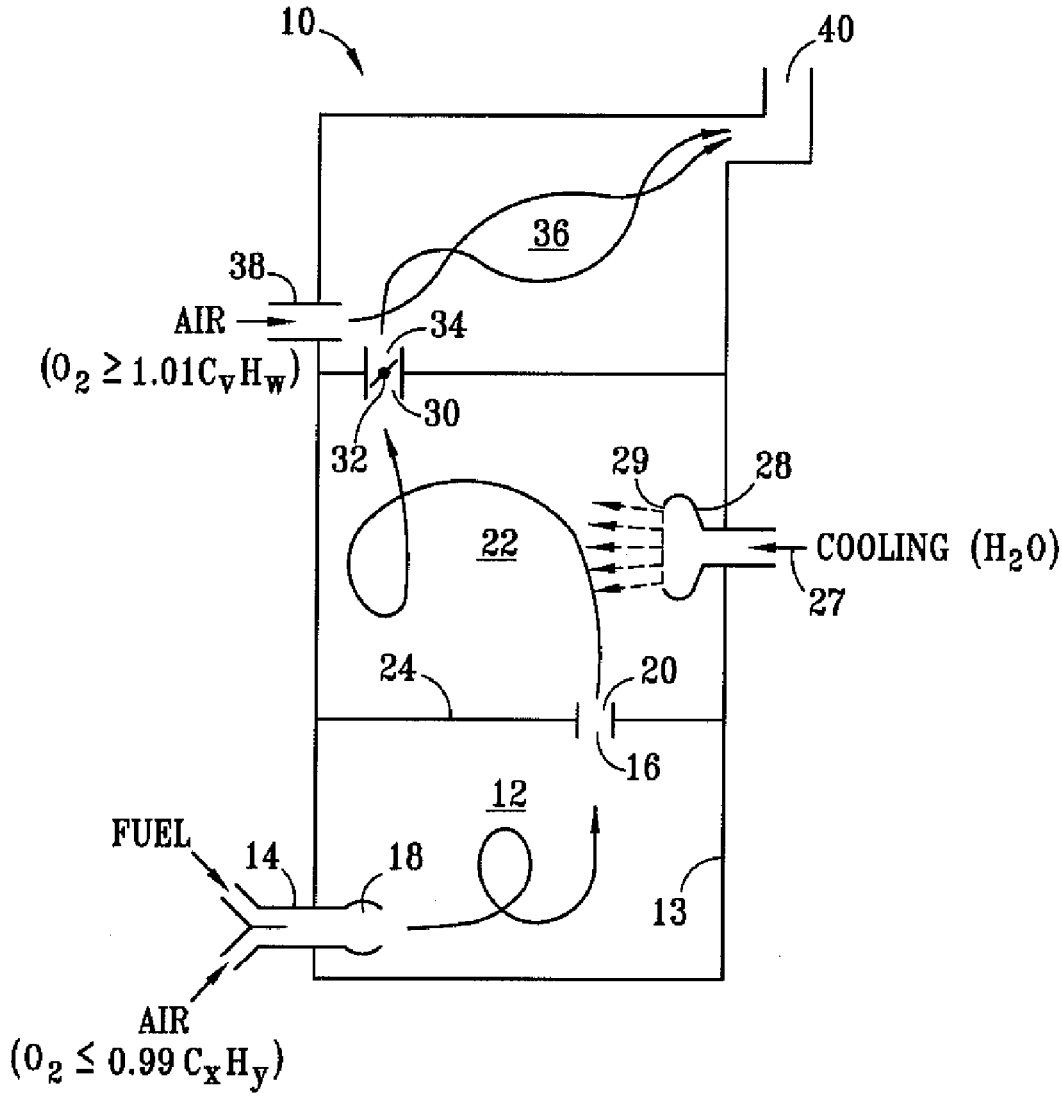
FIG. 2 is a schematic view of an apparatus and process for burning hydrocarbon fuel in air according to an embodiment of the invention.

An $NO_X$ emission reduction afterburner apparatus is shown in FIG. 2 for the combustion of evolved hydrocarbon in an industrial exhaust gas stream to produce reduced $NO_X$ exhaust emissions according to one embodiment of the invention. The inventive afterburner apparatus 10 includes a burning zone 12 having an injector 14, an outlet 16 and a burner 18. The burning zone may be formed as any of a number of combustion chambers 13 and in particular may comprise a continuous flow industrial combustion chamber 13. The burner 18 may be any of a number of possible burners capable of igniting or other wise heating gasses in the burning zone 12 to a temperature of above about 950° C.-1000° C. For example, the injector 14 may input a mixture of fuel and air or may include separate ports for combining fuel and air in a desired mixture of equivalence ratio. The injector 14 may be separate from, or may be integrally connected to, the burner 18 to provide fuel and air for combustion in the burning zone 12. The outlet 16 of the burning zone 12 is in fluid communication with a receiver 20 into a cooling zone 22.

In one embodiment, the burning temperature in the burning zone 12 and the ER ratio of less than 1.0 are uniquely maintained by initially adjusting the supply of methane fuel and air to the burner 18. An appropriate amount of methane and an appropriate amount of air are provided to produce an anticipated volumetric gas flow at the desired temperature of above about 900° C. The proportion of air and fuel is also adjusted so that the ER ratio is at the desired ratio below one (ER<1.0). The volume of methane and air initially supplied into the burner may be adjusted to be substantially equal to the expected volumetric flow of exhaust gas. Depending upon the size of the burner 18 and the volume of exhaust gas, more than one burner 18 might be required. The temperature in the burning zone 12 is monitored as the exhaust gas is introduced into the afterburner. As the exhaust gas is introduced into the burning zone of the after burner, the supply of methane to the burner 18 is adjusted to keep the temperature constant or at least within the desired range, for example at about 950 or above. The fuel to the burner is adjusted without readjusting the amount of air. Initially injection of the exhaust stream into the burning zone will require a reduction of the amount of methane so temperature does not increase. The reduction of methane to the burner will theoretically correspond to the additional amount of hydrocarbon fuel contained within the exhaust gases. Thus, according to this aspect of the inventive afterburner, a steady temperature is maintained in the burning zone 12 of the afterburner by adjusting the supply of methane. The total amount of "fuel" in the afterburner is the sum of the methane plus any hydrocarbon in the exhaust stream coming from the industrial process. The temperature is established according to the heat generated by hydrocarbon combustion with the steady, lean amount of air. It will be understood that in order for the temperature to be maintained the heat previously provided by burning methane will subsequently be provided by the heat of combustion of entrained hydrocarbon in the exhaust gas. The amount of oxygen in the air supplied to the methane/air burner stays substantially constant and therefore the ER ratio in the mixture in the burning zone is also maintained such that there is an excess of hydrocarbon. An amount of unburned hydrocarbon in the exhaust stream will result. The residence time in the burning zone is controlled according to the volume of gas, the volumetric capacity of the burning zone 12, and the time required at the reaction temperature for complete combustion (all available oxygen combined with hydrocarbon). There is an outlet 16 between the burning zone 12 and a receiver 20 leading into a cooling zone 22.

The cooling zone 22 includes the receiver 20 that may comprise a transitional portion of the outlet 16, a separate conduit, or simply an opening in wall 24 between combustion chamber 13 and a cooling enclosure 26 of the cooling zone 22 and by which combustion gasses may be received from the outlet 16 of the burning zone 12. A cooling mechanism 28, such as a water spray nozzle 28, is provided to cool the combustion gases to a selected process temperature, in this embodiment a temperature of about 750° C. There is an exit 30 by which the cooled gases are permitted to leave the cooling zone. The exit 30 may include a temperature controlled valve 32 that regulates the flow of gases having the appropriate temperature. For example a valve 32 might only open and/or only permit the flow of gases having a temperature of less than about 750° C. The exit 30 is in fluid communication with an entrance 34 to an oxidation zone 36. The oxidation zone 36 includes an oxidant source 38 that provides an excess of air for oxidation within the oxidation zone 36. An exhaust discharge 40 is provided to allow gasses to be finally discharged from the low $NO_X$ combustion device 10.

In operation an air and hydrocarbon fuel mixture, regulated at an equivalence ratio of less than 1.0 (for example ER=0.99:1 or less), is introduced through injector 14 into the burning zone 12 and burns, as for example with a burner 18, at a temperature of greater than about 900° C., for example about 950° C. or in a range of 900° C.-1500° C., to insure both thermal cracking of the large hydrocarbon chains and also to insure complete combustion of all $O_2$ present. Because all of the $O_2$ in the combustion mixture is required for combination with the carbon and hydrogen, there is no $O_2$ left over to form $NO_X$. To keep the cost of fuel lower, a temperature in the lower part of the range might be selected. To insure complete and rapid break down of all hydrocarbons a higher temperature might be selected.

Generally, the $NO_X$ reactions are less favored (lower reaction energy) than the carbon and hydrogen oxidation reactions. The burned gas mixture resulting from the burning zone will be composed of $CO_2$, $H_2O$, uncombined nitrogen N, uncombined sulfur S (if any were present in the fuel), and any unburned light hydrocarbons portions, $C_vH_w$. The entire high temperature gas mixture exits from the burning zone through exit 16 and is received through receiver 20 into a cooling zone 22. A cooling device 28, such as water 27 sprayed through a nozzle 29, cools the temperature of the burned gas and the unburned gas mixture down to less than about 800° C., for example about 750° C. or less. Gasses that are sufficiently cooled exit from the cooling zone 22 through exit 30. A temperature control valve 32 may be provided to insure that only gasses at a sufficiently cooled temperature exit. The unburned gasses intermix in the oxidation zone with $O_2$ at an equivalency ratio with greater than 1, for example $1(O_2):1(C_vH_w)$ or greater, for completion of oxidation of the previously unburned portions of the cooled gasses. The $O_2$ may be conveniently provided from an $O_2$ source 38 such as air introduced through an air jet. The oxidation of the unburned hydrocarbon $C_vH_w$ is completed to form $CO_2$ and $H_2O$ at temperatures of about 750° C., for example less than about 800° C. and more than about 700° C. At this reduced temperature thermal cracking of the $O_2$ and $N_2$ in the air does not generally result and therefore thermal $NO_X$ is not generally produced. The resulting gasses are exhausted through exhaust 40. In the event that the initial fuel or hydrocarbon in the industrial process was not chemically stabilized or otherwise depleted of nitrogen and nitrogen compounds, the chemical components of nitrogen in the exhaust that were evolved from the fuel should not result in the formation of a significant amount of chemical $NO_X$, and rather such nitrogen components should ultimately become harmless nitrogen that can be exhausted with the gas stream into the air as $N_2$.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An afterburning method for reducing $NO_X$ emissions from industrial exhaust containing evolved hydrocarbon comprising:

burning exhaust hydrocarbon in an air mixture at an equivalency ratio of oxidant to hydrocarbon of $ER_{HT}<1.0$ at above a first temperature of about 900° C. and sufficiently high to break the bonds in the hydrocarbon fuel and for a sufficient time period for all of the oxygen in the exhaust hydrocarbon/air mixture to combine substantially completely with disassociated carbon and hydrogen components of the exhaust hydrocarbon and to thereby produce carbon dioxide, water, and a portion of unburned light hydrocarbon gas;

cooling the unburned light hydrocarbon gas to below a second temperature of less than about 800° C.; and oxidizing the unburned light hydrocarbon gas substantially completely in an oxygen rich atmosphere at below the second temperature.

2. The method of claim 1 wherein burning at above the first high temperature comprises burning at above about 950° C.

3. The method of claim 1 wherein burning at above the first high temperature comprises burning at temperatures within a range of about 900° C. to about 1500° C.

4. The method of claim 1 wherein cooling the light hydrocarbon gas to below a second temperature comprises cooling the light hydrocarbon gas to below about 750° C. and oxidizing the unburned light hydrocarbon below a second temperature comprises oxidizing below a second temperature of about 750° C.

5. The method of claim 1 wherein cooling the light hydrocarbon gas to below a second temperature comprises cooling the light hydrocarbon gas to about 750° C. and oxidizing the unburned light hydrocarbon below a second temperature comprises oxidizing at a temperature of about 750° C.

6. The method of claim 1 wherein cooling the light hydrocarbon gas to below a second temperature comprises cooling the light hydrocarbon gas to temperatures within a range of about 600° C. to about 800° C. and oxidizing the unburned light hydrocarbon below a second temperature comprises oxidizing within a temperature range of about 600° C. to about 800° C.

7. The method of claim 1 wherein cooling the unburned light hydrocarbon gas to below the second temperature, comprises:

receiving the unburned light hydrocarbon gas into a cooling zone; and injecting water into the cooling zone until the temperature of the unburned light hydrocarbon gas is less than the second temperature.

8. The method of claim 1 wherein oxidizing the unburned light hydrocarbon gas substantially completely at below the second temperature comprises injecting an excess amount of oxygen into the relatively lower temperature gas to form an oxidizing mixture having an equivalency ratio ($ER_{LT}$) greater than 1 oxygen to 1 hydrocarbon ($ER_{LT}>1.0$).

9. The method of claim 1 wherein oxidizing the unburned light hydrocarbon gas substantially completely at a temperature of less than about 800° C. comprises injecting an excess amount of oxygen into the light hydrocarbon gas to form a mixture having an equivalency ratio ($ER_{LT}$) greater than 1 oxygen to 1 hydrocarbon ($ER_{LT}>1.0$).

10. An afterburning method for reducing $NO_X$ emissions from industrial exhaust containing evolved hydrocarbon comprising:

burning exhaust hydrocarbon in an air mixture at an equivalency ratio of oxidant to hydrocarbon of $ER_{HT}<1.0$ at a sufficiently high temperature above about 950° C. to break the bonds in the hydrocarbon fuel and for a sufficient time period for all of the oxygen in the exhaust hydrocarbon/air mixture to combine substantially completely with disassociated carbon and hydrogen components of the exhaust hydrocarbon and to thereby produce carbon dioxide, water, and a portion of unburned light hydrocarbon gas;

cooling the unburned light hydrocarbon gas to a relatively lower temperature of less than about 750° C.; and oxidizing the unburned light hydrocarbon gas substantially completely in an oxygen rich atmosphere at the relatively lower temperature of less than about 750° C.

11. An afterburner for combustion of hydrocarbon, from a hydrocarbon evolving industrial process, in a mixture including air to produce reduced $NO_X$ emissions, the afterburner comprising:

a combustion zone;

a low $NO_X$ methane burner in the combustion zone for heating and burning of methane and air mixture above a first temperature of more than about 900° C. to produce a hot gas;

an injector for providing an exhaust gas stream containing hydrocarbon into combustion zone;

a temperature control for controlling the temperature in the burning zone comprising an adjustment for the amount of methane gas supplied to the $NO_X$ burner the mixture of hot gas, hydrocarbon exhaust gas, and air mixture, to maintain both the first temperature at more than about 900° C. and the equivalence ratio $ER_{HT}$ of (oxygen):(hydrocarbon)<1.0 a cooling zone in fluid communication with the burning zone for receiving the hot gas from the burning zone and for cooling the hot gas to below a second temperature of less than about 800° C.;

an oxidation zone having an inlet for receiving the gas from the cooling zone and having an oxygen source for providing oxygen into the gas in the oxidation zone; and an exhaust exit.

12. An afterburning method for reducing $NO_X$ emissions from industrial exhaust containing evolved hydrocarbon comprising:

burning exhaust hydrocarbon in an air mixture at an equivalency ratio of oxidant to hydrocarbon of $ER_{HT}<1.0$ at above a first temperature of about 900° C.

and sufficiently high to break the bonds in the hydrocarbon fuel and for a sufficient time period for all of the oxygen in the exhaust hydrocarbon/air mixture to combine substantially completely with disassociated carbon and hydrogen components of the exhaust hydrocarbon and to thereby produce carbon dioxide, water, and a portion of unburned light hydrocarbon gas;

cooling the unburned light hydrocarbon gas to below a second temperature of less than about 800° C.; and oxidizing the unburned light hydrocarbon gas substantially completely in an oxygen rich atmosphere at below the second temperature, wherein oxidizing the unburned light hydrocarbon gas substantially completely at below the second temperature may be represented by the following generalized chemical equation:

$$CO_2+H_2O+C_vH_{w\ (volatile\ unburned\ hydrocarbon)}+ER_{LT}O_2 \rightarrow CO_2+H_2O$$

where $ER_{LT}$ (is the equivalency ratio of $O_2$ to the remaining volatile unburned hydrocarbon for the relatively lower temperature oxidation) and $ER_{LT}>1.0$.

13. An afterburning method for reducing $NO_X$ emissions from industrial exhaust containing evolved hydrocarbon comprising:

burning exhaust hydrocarbon in an air mixture at an equivalency ratio of oxidant to hydrocarbon of $ER_{HT}<1.0$ at above a first temperature of about 900° C. and sufficiently high to break the bonds in the hydrocarbon fuel and for a sufficient time period for all of the oxygen in the exhaust hydrocarbon/air mixture to combine substantially completely with disassociated carbon and hydrogen components of the exhaust hydrocarbon and to thereby produce carbon dioxide, water, and a portion of unburned light hydrocarbon gas wherein burning at above the first high temperature may be represented in a generalized chemical equation by the following chemical equation:

$$C_xH_yN_{z1}O_{z2}S_{z3}+ER_{HT}(O_2N_2) \rightarrow a(CO_2)+b(H_2O)+c(C_vH_w)+[d(SO_{x2})+e(NO_x)+f(O_2)+g(N_2)]$$

where, $ER_{HT}$ (is the equivalency ratio of $O_2$ to hydrocarbon for the high temperature burning) and $ER_{HT}<1.0$; where, v, w, z1, z2, z3<<x, y; and where a, b, c, d, e, f, and g are coefficients determined by the size of v, w, x, y, and z such that the chemical equation is balanced;

cooling the unburned light hydrocarbon gas to below a second temperature of less than about 800° C.; and oxidizing the unburned light hydrocarbon gas substantially completely in an oxygen rich atmosphere at below the second temperature.

* * * * *